US007915982B2

(12) United States Patent
Chiesi et al.

(10) Patent No.: US 7,915,982 B2
(45) Date of Patent: Mar. 29, 2011

(54) DEVICE FOR DETECTING THE THREE STATES OF A CIRCUIT BREAKER

(75) Inventors: Laurent Chiesi, Reaumont (FR); Stephane Collot, Chateaudouble (FR); Benoit Grappe, Saint Egreve (FR); Sylvain Paineau, Voiron (FR); Marc Vernay, Meylan (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 191 days.

(21) Appl. No.: 12/302,838

(22) PCT Filed: May 15, 2007

(86) PCT No.: PCT/EP2007/054675

§ 371 (c)(1),
(2), (4) Date: Dec. 24, 2008

(87) PCT Pub. No.: WO2007/137938

PCT Pub. Date: Dec. 6, 2007

(65) Prior Publication Data

US 2009/0273873 A1 Nov. 5, 2009

(30) Foreign Application Priority Data

May 31, 2006 (FR) ..... 06 51970

(51) Int. Cl.
*H01H 73/12* (2006.01)

(52) U.S. Cl. ..... 335/17; 335/205; 335/206; 340/638; 340/644; 340/652; 200/308

(58) Field of Classification Search ..... 335/17, 335/205–207; 200/308; 340/638, 644, 652
See application file for complete search history.

(56) References Cited

U.S. PATENT DOCUMENTS

| | | | | |
|---|---|---|---|---|
| 3,486,144 | A * | 12/1969 | Paige | 335/206 |
| 4,233,694 | A * | 11/1980 | Janosko et al. | 4/541.3 |
| 5,932,856 | A * | 8/1999 | Lopes et al. | 200/61.58 R |
| 6,320,145 | B1 | 11/2001 | Tai et al. | |
| 6,348,861 | B1 | 2/2002 | Li | |
| 6,400,547 | B1 | 6/2002 | Pohl | |
| 7,164,335 | B2 * | 1/2007 | Forsythe | 335/207 |
| 2004/0130217 | A1 | 7/2004 | Moldovan et al. | |

FOREIGN PATENT DOCUMENTS

| | | |
|---|---|---|
| DE | 44 30 382 | 2/1996 |
| EP | 1 435 635 | 7/2004 |
| WO | 99 18645 | 4/1999 |

OTHER PUBLICATIONS

U.S. Appl. No. 12/373,372, filed Jan. 12, 2009, Chiesi, et al.

* cited by examiner

*Primary Examiner* — Ramon M Barrera
(74) *Attorney, Agent, or Firm* — Oblon, Spivak, McClelland, Maier & Neustadt, L.L.P.

(57) ABSTRACT

A device for detecting three states, namely 'on', 'off' and 'triggered' of an electric circuit breaker. The device includes a mobile magnetic device, movable between three positions corresponding to the three states of the circuit breaker, and at least one permanent magnet generating a magnetic field provided with magnetic field lines for driving two DIP switches via the magnetic effect. In each of the magnetic device's positions, the two DIP switches are controlled in either an open or closed position to form a specific combination representing one of the three states of the circuit breaker.

13 Claims, 5 Drawing Sheets

Fig. 2
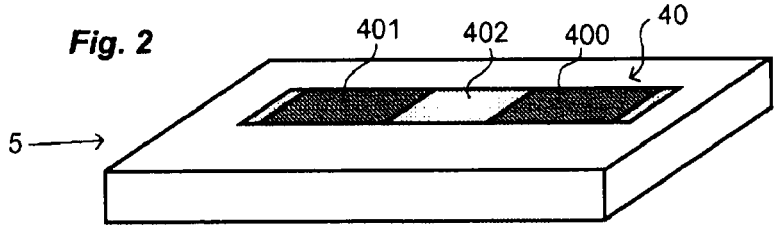
Fig. 3
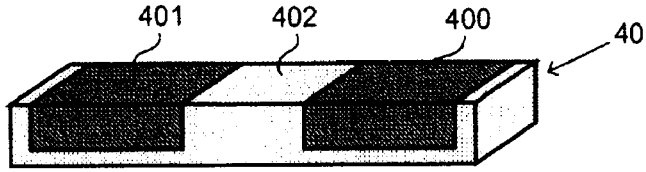
Fig. 4
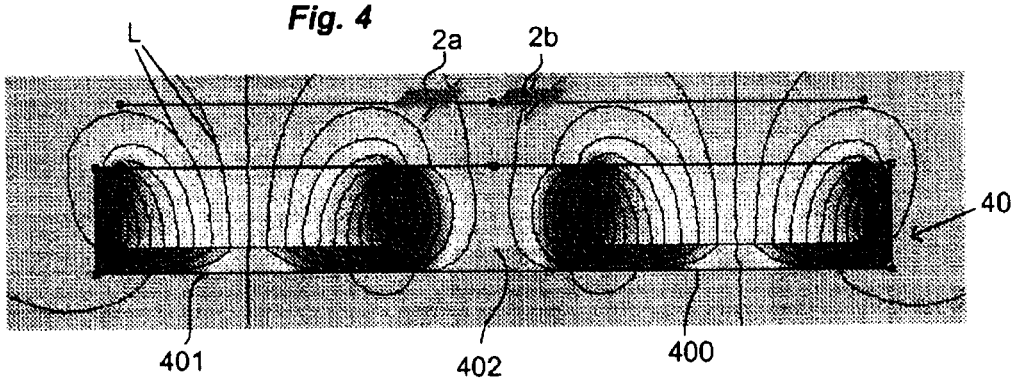
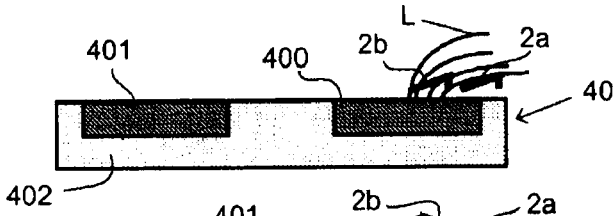
Fig. 5A
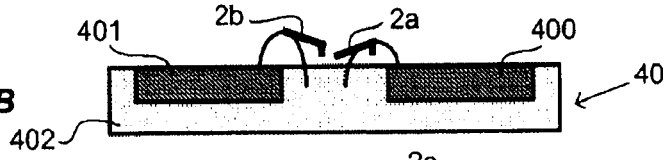
Fig. 5B
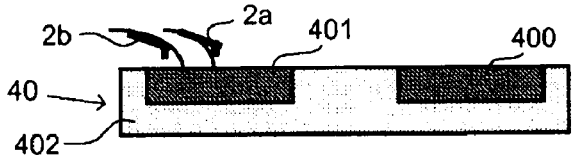
Fig. 5C Fig. 6
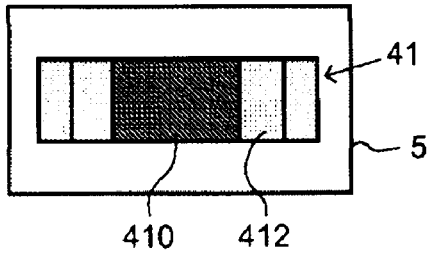
Fig. 7
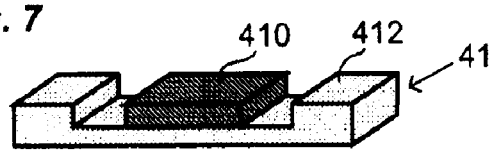
Fig. 8
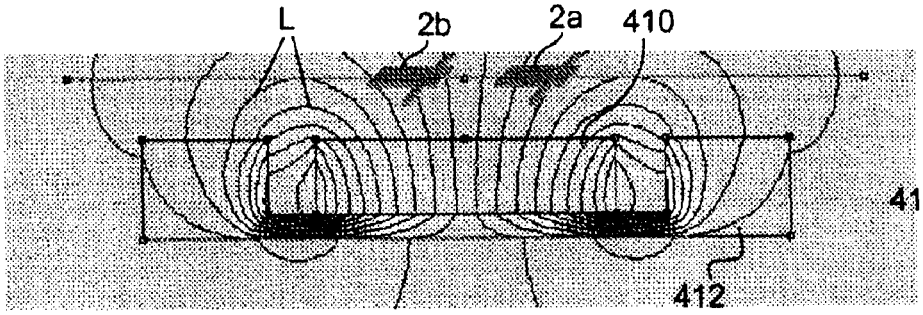
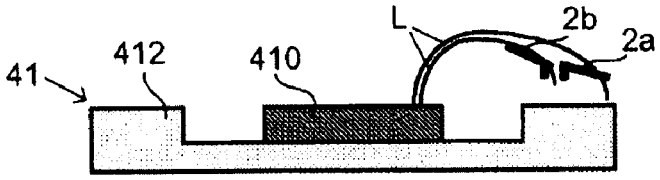
Fig. 9A
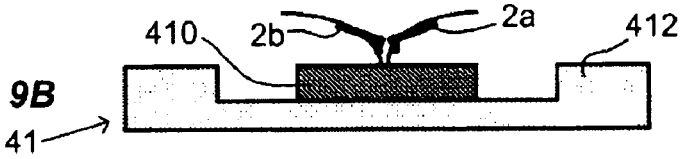
Fig. 9B
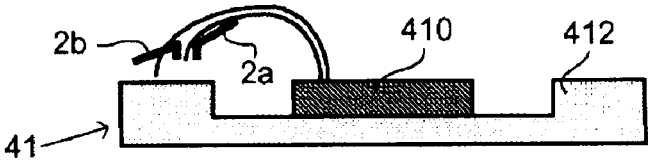
Fig. 9C

DEVICE FOR DETECTING THE THREE STATES OF A CIRCUIT BREAKER

The present invention relates to a device for detecting the three states, "On", "Off" and "Trip" of an electric circuit breaker.

Through document U.S. Pat. No. 4,969,063, a device for detecting and signalling the three states "On", "Off" and "Trip" of an electric circuit breaker is known. This device comprises a three-position switch mechanically coupled with the member for actuating the circuit breaker. The three-position switch is materialized by three electric tracks each allocated to one of the positions of the actuation member and interacting with a moveable electric contact secured to the actuation member. Depending on the position of the actuation member, the switch switches on a first LED of a first colour, a second LED of a second colour or both LEDs at the same time to mix their colours.

This type of device operates by mechanical contact between the actuation member and the electric tracks. These tracks may become worn gradually with the switchings of the actuation member, eventually affecting the quality of the electric connections. Also, if, in one of its positions, the actuation member has some clearance, the electric connection between the moveable contact and the corresponding magnetic track may be deficient.

The object of the invention is to propose a device for detecting the three states of a circuit breaker that is reliable, precise, requires little space and whose electric connections do not risk wear that is too premature.

This object is achieved by a device for detecting the three states of an electric circuit breaker, characterized in that it comprises:

- a moveable magnetic device, that can be moved between three positions corresponding to the three states of the circuit breaker and comprising at least one permanent magnet,
- two microswitches that can be controlled by magnetic effect by the permanent magnet, and in that:
- each microswitch has a moveable element capable of being aligned in an orientation of the magnetic field lines in order to take an open position or a closed position,
- in each position of the magnetic device, the two microswitches are controlled in the open position or in the closed position in order to form a particular combination representative of one of the three states of the circuit breaker.

According to a particular feature, the magnetic device is mechanically coupled to an actuation member of the circuit breaker capable of taking three positions corresponding to the three states of the circuit breaker.

According to a first variant embodiment of the invention, the magnetic device is actuated in translation.

According to one particular feature, the magnetic device comprises a symmetrical part made of ferromagnetic material. In a first configuration, the ferromagnetic part has for example two U-shaped branches and the permanent magnet is mounted symmetrically on the ferromagnetic part, between the two branches. In a second configuration, the ferromagnetic part may also have three branches in order to form an E, a permanent magnet occupying each one of the two hollows formed by the three branches of the ferromagnetic part.

According to a second variant embodiment, the magnetic device is actuated in rotation. The permanent magnet of the magnetic device is for example mounted on a frame actuated pivotingly by a rail mechanically coupled to the actuation member.

According to the invention, the moveable element is for example a ferromagnetic membrane capable of pivoting under the magnetic effect.

According to the invention, the detection device comprises a signalling device responsible for indicating each of the three states of the circuit breaker depending on the position of the microswitches. The signalling device is for example mounted on the casing of the circuit breaker or is remote relative to the circuit breaker.

The invention also relates to an electric circuit breaker comprising a detection device as defined above and a system for monitoring a plurality of circuit breakers of this type. The monitoring system comprises for example a communication bus to which the circuit breaker detection devices are connected. This communication bus is connected to a central terminal responsible for processing and centralizing the signals received and displaying the state of each of the circuit breakers connected to the bus according to these signals. The display may be produced on an illuminated board or on a screen of the terminal.

Other features and advantages will appear in the following detailed description with reference to an embodiment given as an example and represented by the appended drawings in which:

FIG. 2 represents in perspective a first embodiment of a moveable plate of the detection device of the invention.

FIG. 3 represents, in perspective, a magnetic device according to a first embodiment.

FIG. 4 shows the field lines of the magnetic field generated by the magnets of the magnetic device of FIG. 3. This figure also shows two microswitches at rest.

FIGS. 5A to 5C represent, in a side view, in three different positions, the magnetic device of FIG. 3 and show the influence of the magnetic fields generated by its permanent magnets on the state of the two microswitches.

FIG. 6 shows, in a top view, a second embodiment of the moveable plate of the detection device of the invention.

FIG. 7 represents a magnetic device according to a second embodiment.

FIG. 8 shows the field lines of the magnetic field generated by the permanent magnet of the magnetic device of FIG. 7. FIG. 8 also represents two microswitches at rest.

FIGS. 9A to 9C represent, in a side view, the magnetic device of FIG. 7 in three different positions and show the influence of the magnetic field generated by its permanent magnet on the state of the two microswitches.

Figure 1A:
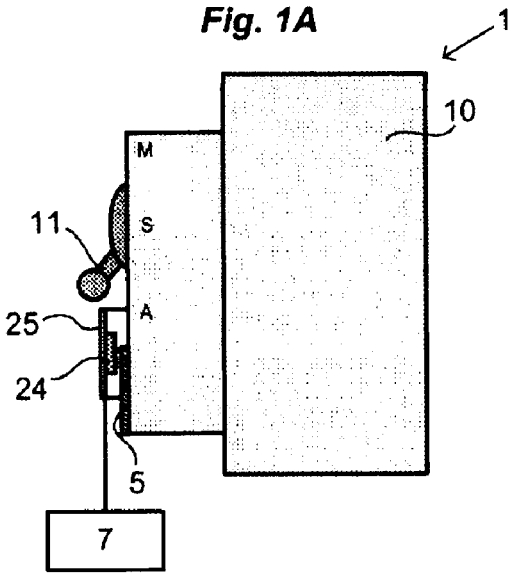
FIGS. 1A to 1C represent, in side view, an electric circuit breaker with three positions, respectively in the "Off", "On" and "Trip" state and furnished with a detection device according to the invention.
Figure 1B:
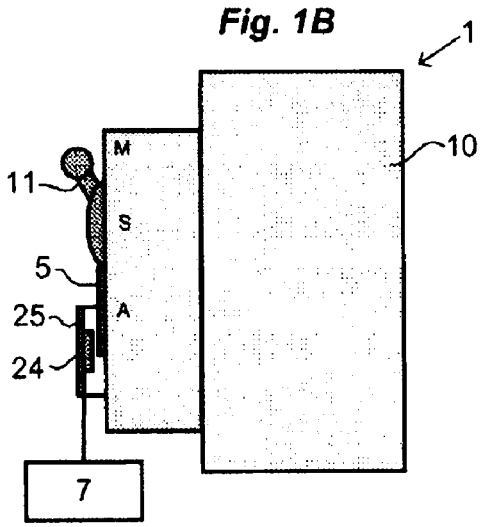
Figure 1C:
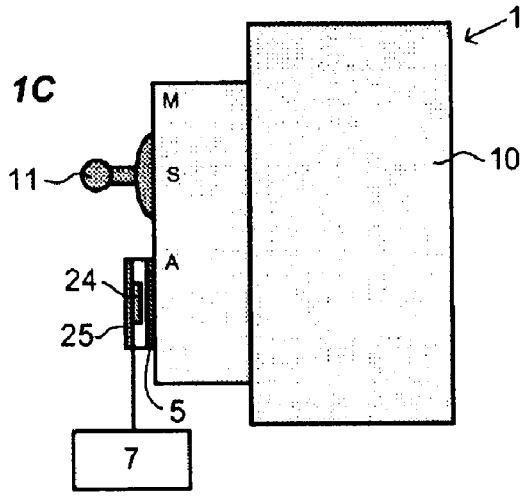

The detection device according to the invention is designed to be installed in a three-position electric circuit breaker 1. In a known manner, a circuit breaker 1 comprises a casing 10 on which is mounted an actuation member consisting for example of an operating device 11 that pivots or rotates. In FIGS. 1A to 1C, the operating device has the shape of a pivoting lever but it should be understood that it may equally take the shape of a rotating button.

The operating device 11 may be set in motion between three positions, an "On" (M) position, an "Off" (A) position and a "Trip" (D) position situated halfway between the "On" (M) position and the "Off" (A) position. The movement of the operating device from the "On" (M) position to the "Trip" (D) position is carried out automatically when an electric fault such as a short circuit is detected. In each of the three positions (M, A, D) of the operating device 11, the circuit breaker is therefore respectively in the "On", "Off" or "Trip" position.

The detection device comprises at least two adjacent microswitches 2*a*, 2*b* (both referenced 2) mounted on an electric signalling circuit C and designed to detect the state of the circuit breaker 1.

Figure 13A:
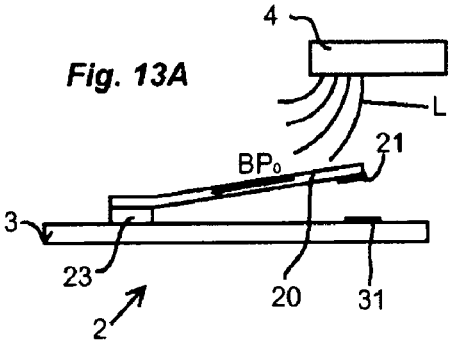
FIGS. 13A and 13B represent the microswitch of FIG. 12 respectively in the open position and in the closed position, actuated by a permanent magnet.
Figure 13B:
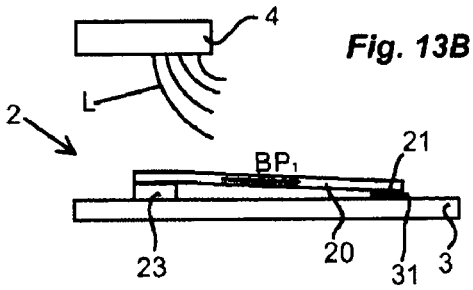

Each of these microswitches 2*a*, 2*b* may be switched by an actuator between two positions, an open position (FIG. 13A) and a closed position (FIG. 13B).

According to the invention, between their two positions, these microswitches 2*a*, 2*b* are controlled by magnetic effect. Each of these microswitches 2*a*, 2*b* is sensitive to the orientation of the field lines L of a magnetic field generated by a magnetic actuator. This type of microswitch 2 is for example manufactured in MEMS (for "Micro-Electro-Mechanical System") technology.

Figure 12:
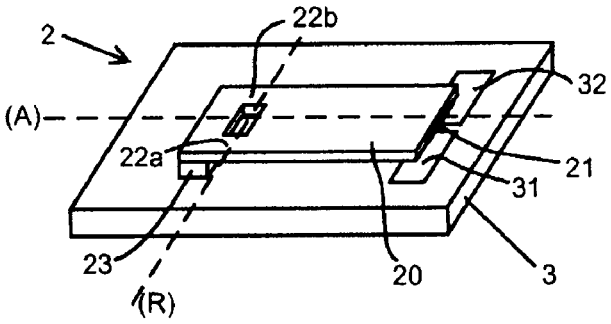
FIG. 12 represents a microswitch such as that employed in the detection device of the invention.

An exemplary configuration of a microswitch 2 sensitive to the orientation of the field lines L is represented in FIGS. 12 to 13B.

A microswitch 2 sensitive to the orientation of the field lines L comprises a deformable ferromagnetic moveable membrane 20 that is able to be actuated in rotation about an axis of rotation (R) by the magnetic actuator. The membrane 20 is for example made of iron-nickel.

The membrane 20 has a longitudinal axis (A) and is connected, at one of its ends, by means of connecting arms 22*a*, 22*b*, to one or more anchoring blocks 23 secured to a substrate 3. The membrane 20 is capable of pivoting relative to the substrate 3 on its axis (R) of rotation perpendicular to its longitudinal axis (A). The connecting arms 22*a*, 22*b* form an elastic connection between the membrane 20 and the anchoring block 23 and are flexed when the membrane 20 pivots. The two microswitches 2*a*, 2*b* are for example made on one and the same substrate 3.

At its distal end relative to its axis of rotation, the membrane 20 supports a moveable contact 21. By pivoting, the membrane 20 may take at least two determined positions, an open position (FIG. 13A) in which two fixed electric tracks 31, 32 deposited on the substrate 3 are disconnected, or a closed position (FIG. 13B) in which the two tracks 31, 32 are connected together by the moveable contact 21 supported by the membrane 20.

One of the methods of actuating the membrane 20 consists in applying a magnetic field created by a permanent magnet 4. The ferromagnetic membrane 20 moves between its two positions aligning itself on the field lines L of the magnetic field generated by the permanent magnet 4. With reference to FIGS. 13A and 13B, the magnetic field of the permanent magnet 4 has field lines L whose orientation generates a magnetic component $BP_0$, $BP_1$ in a ferromagnetic layer of the membrane 20 along its longitudinal axis (A). This magnetic component $BP_0$, $BP_1$ generated in the membrane 20 engenders a magnetic torque forcing the membrane 20 to take one of its positions, closed (FIG. 13B) or open (FIG. 13A). By moving the permanent magnet 4 relative to the membrane 20, it is therefore possible to subject the membrane to two different orientations of the field lines L of the magnetic field of the permanent magnet 4 and to cause the membrane 20 to tilt between its two positions.

This principle of actuation is employed in the detection device according to the invention.

The detection device comprises a plate 5 that can move in translation, for example made of plastic, mechanically coupled to the operating device 11 and capable of taking three positions corresponding to the three states of the circuit breaker 1. With reference to FIGS. 1A to 1C, this plate 5 is for example mounted on a sliding rail and may take a low position (FIG. 1A) when the operating device 11 is in the "Off" (A) position, a high position (FIG. 1B) when the operating device 11 is in the "On" (M) position or a middle position (FIG. 1C), situated between the high position and the low position, when the operating device 11 is in the "Trip" (D) position.

The moveable plate 5 supports a magnetic device 40, 41 with one or two permanent magnets, designed to actuate the microswitches 2*a*, 2*b* between their two positions.

FIG. 3 shows a magnetic device 40 according to a first embodiment, comprising two identical permanent magnets 400, 401. This magnetic device consists of a symmetrical part 402 having an E-shaped longitudinal section and made of ferromagnetic material. This ferromagnetic part 402 has two hollows each occupied totally by a permanent magnet 400, 401 flush with the top surface and the lateral surfaces of the ferromagnetic part 402.

On its top face, the magnetic device 40 has successively a first end ferromagnetic portion, a first magnetic portion consisting of the first permanent magnet 400, a second central ferromagnetic portion, a second magnetic portion consisting of the second permanent magnet 401 and a third end ferromagnetic portion. The arrangement of the permanent magnets 400, 401 in the ferromagnetic part 402 makes it possible to confine the field lines of the magnetic fields generated by the two permanent magnets 400, 401 around the magnetic device 40 (FIG. 4).

FIG. 7 shows a magnetic device 41 according to a second embodiment comprising a single permanent magnet 410. This magnetic device also comprises a symmetrical part 412 made of ferromagnetic material having, for its part, a U-shaped longitudinal section. The permanent magnet 410 is positioned symmetrically between the two branches of the U-shaped part, leaving a hollow on either side. FIG. 8 shows the field lines L of the magnetic field generated by the permanent magnet 410 in this magnetic device 41. The presence of the ferromagnetic part 412 also makes it possible to confine the field lines L around the magnetic device 41 (FIG. 8).

On its top face, the magnetic device 41 according to this second embodiment has successively a first end ferromagnetic portion, a hollow, a central magnetic portion consisting of the permanent magnet 410, a second hollow and a second end ferromagnetic portion.

According to the invention, the microswitches 2*a*, 2*b* enclosed in a casing 24 are mounted on a printed circuit 25 fixed opposite the moveable plate 5 (FIGS. 1A to 1C).

The microswitches 2*a*, 2*b* are positioned so that their axes of rotation (R) are parallel to the plane of translation of the moveable plate 5 and perpendicular to the direction of translation of the moveable plate 5.

In a first configuration, the moveable plate 5 supports the magnetic device 40 with two permanent magnets 400, 401.

In this first configuration, the two microswitches 2*a*, 2*b* are for example oriented in the same direction.

In the bottom position of the moveable plate 5 (FIG. 1A), the membranes 20 of the two microswitches 2*a*, 2*b* are both aligned in one and the same orientation of the field lines of the first permanent magnet 400, forcing them into a closed position (FIG. 5A).

In the top position of the moveable plate 5 (FIG. 1B), the membranes 20 of the two microswitches 2*a*, 2*b* are both aligned in one and the same orientation of the field lines of the second permanent magnet 401, forcing them into an open position.

In the middle position of the moveable plate 5 (FIG. 1C), the membranes 20 of the two microswitches 2*a*, 2*b* are opposite the central ferromagnetic portion of the magnetic device 40. The membrane 20 of the first microswitch 2*a* is aligned in an orientation of the field lines of the first permanent magnet 400 forcing it into a closed position and the membrane 20 of the second microswitch 2*b* is aligned in an orientation of the field lines of the second permanent magnet 401 forcing it into an open position.

In a second configuration, the moveable plate 5 supports the magnetic device 41 with a single permanent magnet 410. In this configuration, the two microswitches 2*a*, 2*b* are for example oriented in a different direction, for example back-to-back along their axis of rotation (R).

In the bottom position of the moveable plate 5 (FIG. 9A), the membranes 20 of the two microswitches 2*a*, 2*b* are aligned in one and the same orientation of the field lines of the permanent magnet 410, forcing a closed position on the membrane 20 of the first microswitch 2*a* and an open position on the membrane 20 of the second microswitch 2*b*.

In the top position of the moveable plate 5 (FIG. 9C), the membranes 20 of the two microswitches 2*a*, 2*b* are aligned in one and the same orientation of the field lines of the permanent magnet 410, this orientation being inverted relative to that of the field lines seen by the membranes 20 when the plate 5 is in the bottom position. The first microswitch 2*a* is then in the open position and the second microswitch 2*b* is in the closed position.

In the middle position of the moveable plate 5, the two microswitches 2*a*, 2*b* are positioned symmetrically on either side of the axis of symmetry of the magnetic device 41 so that their membranes 20 are each aligned in the two different directions of the field lines of the permanent magnet 410. The two back-to-back microswitches 2*a*, 2*b* are therefore in an open position.

In the two configurations, the two microswitches 2*a*, 2*b* are controlled to form, in each position of the plate 5, a different open and/or closed combination of their membranes 20 and therefore generate on each occasion a different signal representative of the position of the moveable plate 5 and therefore of the position of the operating device 11 and of the state of the circuit breaker 1.

According to a variant embodiment, the magnetic device consists of a single permanent magnet 43 mounted fixedly on a frame 60 actuated in rotation about an axis by a rail 61 mechanically coupled with the operating device 11 directly or indirectly by means of a mechanism interacting on the one hand with the operating device 11 and on the other hand with a trigger (not shown). In a known manner, this rail 61 can be moved in translation to take three positions: an "On" position, an "Off" position and a "Trip" position, depending on the state of the mechanism, in order to represent respectively the "On" state of the circuit breaker, its "Off" state and its "Trip" state. This type of device is described more fully in patents FR 2 834 379 and FR 2 827 703.

In this variant, the magnetic device is not actuated in translation but in rotation about an axis. A combination of a translation and rotary movement of the magnetic device may also be envisaged.

In rotation, the permanent magnet 43 subjects the two microswitches 2*a*, 2*b*, for example enclosed in their casing 24, to a magnetic field having field lines L of different orientations in order to force them into their open or closed position.

Figure 11A:
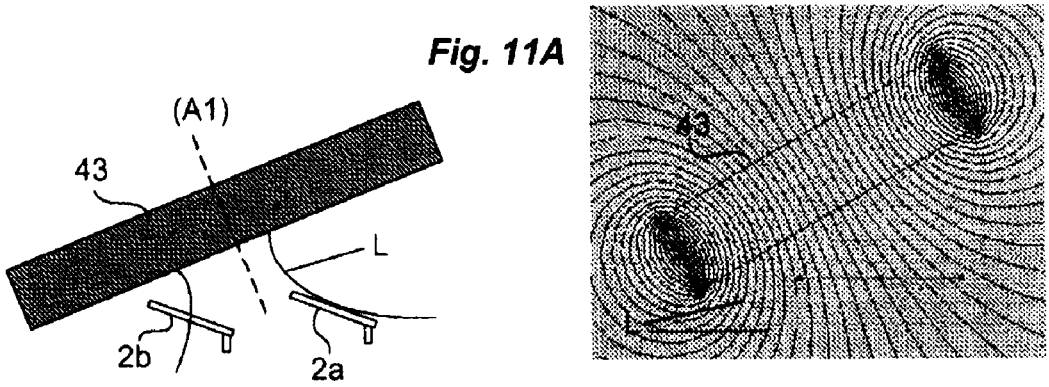
FIGS. 11A to 11C illustrate the principle of operation of the detection device of FIG. 10.
Figure 11B:
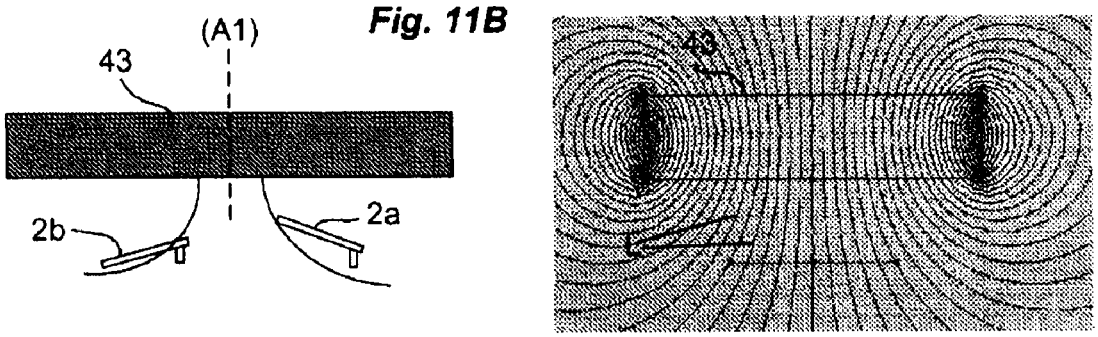
Figure 11C:
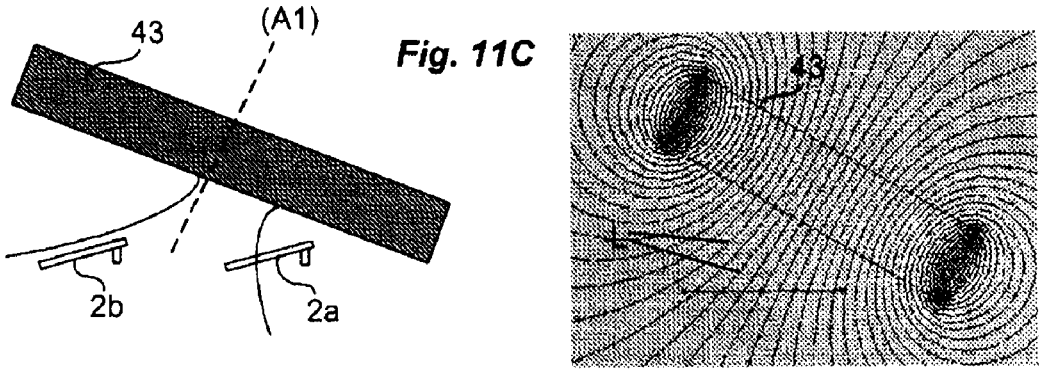

With reference to FIGS. 11A to 11C, the permanent magnet 43 is operated in a rotary movement, above the microswitches 2, about an axis parallel to the axes (R) of rotation of the membranes 20 and in the same direction. The microswitches 2*a*, 2*b* are for example oriented in the same direction and are positioned on either side of the axis (A1) of the magnet 43 so that, when the permanent magnet 43 is parallel to the substrate 3 supporting the microswitches 2*a*, 2*b*, the membrane 20 of the first microswitch 2*a*, aligned in an orientation of the field lines L of the magnetic field of the permanent magnet 43, is in an open position and the membrane of the second microswitch 2*b*, aligned in an opposite orientation of the field lines L, is in the closed position (FIG. 11B).

In FIG. 11A, the permanent magnet 43 is inclined in the anticlockwise direction so that the membrane 20 of the first microswitch 2*a* is aligned in an orientation of the field lines L forcing it into an open position and so that the membrane 20 of the second microswitch 2*b* is aligned in an orientation of the field lines L forcing it also into an open position.

In FIG. 11C, the permanent magnet 43 is inclined in the clockwise direction so that the membrane 20 of the first microswitch 2*a* is aligned in an orientation of the field lines L of the permanent magnet 43 forcing it into a closed position and so that the membrane 20 of the second microswitch 2*b* is aligned in an orientation of the field lines L of the permanent magnet 43 forcing it also into a closed position.

Figure 14:
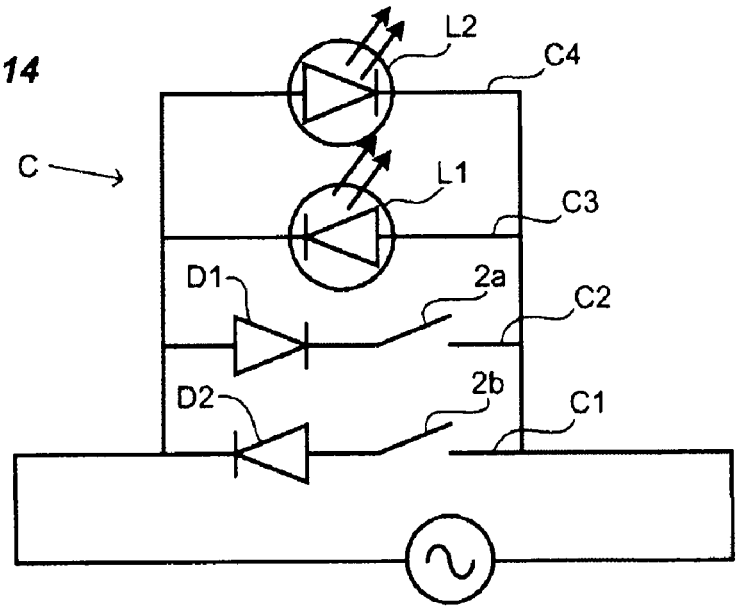
FIG. 14 shows an example of a configuration of a signalling device controlled by two microswitches.
Figure 10:
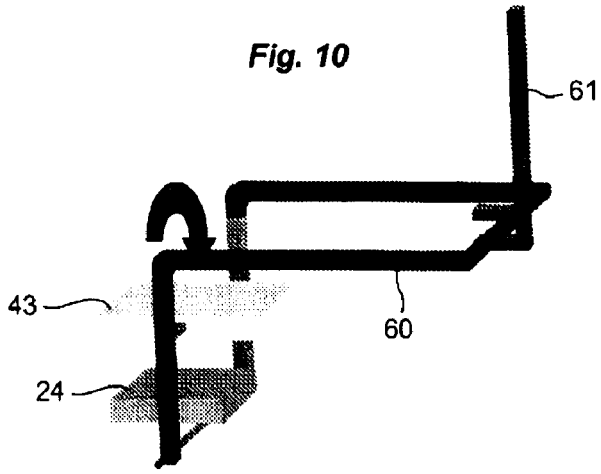
FIG. 10 represents a variant of the detection device according to the invention implemented in a circuit breaker.

Depending on the state of the two microswitches 2*a*, 2*b*, a different signal may be transmitted by a signalling device 7 (FIGS. 1A to 1C) comprising the signalling electric circuit C represented in FIG. 14 and controlled by the two microswitches 2*a*, 2*b*. The diagram shown in FIG. 14 is only an example and is in no way limiting. The signalling device 7 may be mounted on the casing 10 of the circuit breaker or be remote relative to the latter.

The signalling device represented in FIG. 14 is suitable for operating when in a first state of the circuit breaker 1, the two microswitches 2*a*, 2*b* are open, in a second state of the circuit breaker 1 the first microswitch 2*a* is open and the second microswitch 2*b* is closed and in a third state of the circuit breaker, the first microswitch 2*a* is closed and the second microswitch 2*b* is open. These combinations are those obtained with the detection device described above, furnished with the magnetic device 41 according to the second embodiment.

This electric circuit C comprises for example four branches C1, C2, C3, C4 in parallel. Two branches C1, C2 are each controlled by one of the microswitches 2*a*, 2*b*. A diode D1, D2 is mounted in series with each of the microswitches, one being oriented on-state and the other off-state. The other two parallel branches C3, C4 of the circuit C each support an LED (for "Light Emitting Diode") L1, L2, one being oriented on-state and the other off-state.

When the first microswitch 2*a* is closed and the second microswitch 2*b* is open, the first LED L1 is on and the second LED L2 is off. This combination corresponds for example to the "Off" state of the circuit breaker 1.

When the first microswitch 2*a* is open and the second microswitch 2*b* is closed, the first LED L1 is off and the second LED L2 is on. This combination corresponds for example to the "On" state of the circuit breaker 1.

When both microswitches 2*a*, 2*b* are open, both LEDs L1, L2 are on. This combination corresponds for example to the "Trip" state of the circuit breaker 1.

According to the invention, based on the two microswitches 2*a*, 2*b*, the issue therefore is to draw up a truth table representing the states of each of the microswitches 2*a*, 2*b* depending on the position of the moveable plate 5 and the state resulting from the LEDs of the signalling device. This truth table differs depending on the initial configuration of the microswitches 2*a*, 2*b*.

The signalling device 7 may be remote and may be incorporated into a monitoring system designed to monitor the state of several circuit breakers mounted on one and the same board or dispersed in different locations. Advantageously, in this system, the electric signals obtained at the output of the detection device of a circuit breaker 1 are for example sent to a communication bus connected for example to a central computer terminal responsible for processing the signals received and displaying the states of all the circuit breakers thus connected to the bus. The display may be achieved by means of an illuminated board with LEDs or the screen of the terminal.

According to the invention, it is possible to detect more than three mechanical states by employing more than two microswitches arranged in an appropriate manner.

It is well understood that, depending on the position of the magnetic device, the states of the microswitches are dependent on their orientation, on the geometry of the permanent magnet(s) employed or the method of actuating the magnetic device. The various combinations obtained, described above, are not limiting and other configurations may be envisaged.

It is well understood that it is possible, without departing from the context of the invention, to imagine other variants and enhancements of detail and even to envisage the use of equivalent means.

The invention claimed is:

1. An electric circuit breaker having three different states, comprising:

an actuation member configured to take three positions corresponding to the three states of the electric circuit breaker;

a moveable magnetic device configured to be moved between three positions corresponding to the three states of the electric circuit breaker by the actuation member, and having a permanent magnet; and two microswitches configured to be controlled by a magnetic field by the permanent magnet;

wherein each microswitch includes a moveable element configured to be aligned in an orientation of the magnetic field lines of the permanent magnet to take an open position or a closed position, and wherein in each position of the moveable magnetic device, the two microswitches are controlled in an open position or in a closed position to form a particular combination representative of one of the three states of the electric circuit breaker.

2. The electric circuit breaker according to claim 1, wherein the movable magnetic device is mechanically coupled to the actuation member of the electric circuit breaker that is configured to take three positions corresponding to the three states of the electric circuit breaker.

3. The electric circuit breaker according to claim 2, wherein the permanent magnet is mounted on a frame actuated pivotingly by a rail mechanically coupled to the actuation member.

4. The electric circuit breaker according to claim 1, wherein the movable magnetic device is actuated by a translation.

5. The electric circuit breaker according to claim 1, wherein the movable magnetic device further includes a symmetrical part made of ferromagnetic material.

6. The electric circuit breaker according to claim 5, wherein the symmetrical part includes two U-shaped branches and the permanent magnet is mounted symmetrically on the symmetrical part, between the two U-shaped branches.

7. The electric circuit breaker according to claim 5, wherein the ferromagnetic part includes three branches to form an E, and the movable magnetic device includes two permanent magnets each occupying one of two hollows formed by the three branches of the E-formed ferromagnetic part.

8. The electric circuit breaker according to claim 1, wherein the movable magnetic device is actuated by rotation.

9. The electric circuit breaker according to claim 1, wherein the moveable element includes a ferromagnetic membrane configured to pivot under the magnetic field.

10. The electric circuit breaker according to claim 1, further comprising:

a signalling device configured to indicate a signal for each of the three states of the circuit breaker depending on a position of the microswitches.

11. The electric circuit breaker according to claim 10, wherein the signalling device is mounted on the casing of the circuit breaker or is remote relative to the circuit breaker.

12. A system for monitoring a plurality of circuit breakers as defined in claim 1, wherein the circuit breakers are connected to a communication bus linked to a computer terminal responsible for centralizing and displaying each state of the plurality of circuit breakers.

13. A device for detecting three states of an electric circuit breaker, comprising:

a moveable magnetic device configured to be moved between three positions corresponding to the three states of the electric circuit breaker by an actuation member, and having a permanent magnet; and two microswitches configured to be controlled by a magnetic field of the permanent magnet; wherein each microswitch includes a moveable element configured to be aligned in an orientation of the magnetic field lines of the permanent magnet to take an open position or a closed position, in each position of the moveable magnetic device, the two microswitches are controlled in an open position or in a closed position to form a particular combination representative of one of the three states of the electric circuit breaker, and the movable magnetic device includes a U-shaped ferromagnetic element, and the permanent magnet is mounted between the two branches of the U-shaped ferromagnetic element.

* * * * *